United States Patent [19]

Heller et al.

[11] Patent Number: 4,568,386

[45] Date of Patent: Feb. 4, 1986

[54] PROCESS FOR PURIFYING METALS BY INSUFFLATION AND PRODUCT PRODUCED THEREBY

[75] Inventors: Claude Heller, Meudon; Albert-Gilbert Goursat, Voisins le Bretonneux; Jean Foulard, Ablon, all of France

[73] Assignee: L'Air Liquid, Societe Anonyme pour l'Etude et l'Exploitation des Procedes Georges Claude, Paris, France

[21] Appl. No.: 708,277

[22] Filed: Mar. 5, 1985

[30] Foreign Application Priority Data

Mar. 9, 1984 [FR] France ..... 84 03626

[51] Int. Cl.[4] ..... C21C 7/00

[52] U.S. Cl. ..... 75/59.26; 75/59.1; 75/59.28

[58] Field of Search ..... 75/59, 60, 59.1, 59.26, 75/59.28

[56] References Cited

U.S. PATENT DOCUMENTS 3,004,847 10/1961 Lambert ..... 75/60

3,046,107 7/1962 Nelson ..... 75/60

*Primary Examiner*—Peter D. Rosenberg

*Attorney, Agent, or Firm*—Lee C. Robinson, Jr.

[57] ABSTRACT

A process for refining pig iron from below the surface of a molten metal bath, and the resulting product, in which an oxidizing gas is injected in the bath and, during the last refining stage, a mixture of oxidizing gas and inert gas is further injected. The inert gas content x of the mixture is made to vary according to a law corresponding to an oxidizing gas dilution curve that is located in an area determined by two envelope curves, to wit, a first maximum dilution curve defined by the straight line portions:

$x = -766.7\ \%C + 168.7$ for $0.16 < \%C < 0.22$ $x = -550\ \%C + 134$ for $0.1 < \%C < 0.16$ $x = -233\ \%C + 102$ for $\%C < 0.1$ and a second minimum dilution curve defined by the straight line portions:

$x = -1500\ \%C + 255$ for $0.14 < \%C < 0.17$ $x = -400\ \%C + 101$ for $0.1 < \%C < 0.14$ $x = -230\ \%C + 84$ for $0.05 < \%C < 0.1$ $x = -72.5$ for $\%C < 0.05$

8 Claims, 3 Drawing Figures

PROCESS FOR PURIFYING METALS BY INSUFFLATION AND PRODUCT PRODUCED THEREBY

BACKGROUND

This invention relates to a pig iron refining process and to the resulting product, in which an oxidizing gas is injected, such as, e.g., industrially pure oxygen, to eliminate carbon or other oxidizable impurities. More specifically, the invention is directed toward a process and product in which all or part of the oxidizing gas is injected under the surface of a bath of the molten metal. Processes of this general type are mainly known under the names of OBM, QBOP and LWS, when referring to those in which the larger part of the oxygen is blown in from below, and under the names LD-OB, LD-OTB and STB, when referring to those in which only a small part of the oxygen is injected from under the surface of the bath.

In one of the more commonly used processes for producing steel pneumatically, oxygen is blown through a nozzle above the load, in such manner that the jet of oxygen penetrates the molten mass and forms very oxidized slag that, upon contact with the pig, reacts with carbon to produce carbon monoxide. In processes blown via the bottom, oxygen is injected under the surface of the bath through nozzles located in the bottom or near the bottom of the converter. A protecting gas, generally a hydrocarbon or a non-oxidizing gas (that may be in liquified form) is used to surround the current of oxygen in order to reduce wear, a very important factor in the case of nozzles as well as refractory elements in the bottom of the converter. One of the considerable advantages of the latter processes in comparison with the former is the ability to obtain higher metallic yields. These yields are mainly achieved because:

1. the oxygen traversing the metallic bath stirs up the bath more intensely and allows a greater approach to equilibrium conditions, and 2. the amount of iron oxide fumes produced is much smaller since the carbon's oxidation reaction is located in the very essence of the metal, contrary to the refining processes from above in which this reaction takes place at the slag-metal interface. It follows that refining processes from above are inadequate to obtain, under good conditions, low and very low carbon content steel.

New processes have attempted to mitigate this drawback: e.g., the LBE and LDAB processes, in which a neutral gas favoring the rabbling of the metal is injected through the bottom, while not going as far as the processes in which part of the oxygen is injected through the bottom. However, these refining processes through the bottom have so far not made it possible to obtain, in an oxygen converter, low or very low carbon content steel which is not high in dissolved gas content, mainly oxygen.

Nevertheless, refining processes through the bottom yield the lowest dissolved oxygen content compared to refining processes from above.

The presence of dissolved oxygen in the liquid metal is particularly bothersome. When the metal solidifies, this oxygen reacts with oxidizable elements and more specifically with the residual carbon to form CO. The result is a lower carbon content in the solid metal, a lack of homogeneity due to the presence of cavities containing carbon monoxide and, above all, in the case of extra-soft steel, the presence of metallic oxides.

There are several processes which attempt to remedy these drawbacks. The first of these techniques is that called killing. Highly oxidable elements such as aluminum, silicon and other metalloids or mixtures of the latter are added to the liquid metal, before casting in ingots or continuous casting. The elements react with dissolved oxygen to form oxides that decant and are trapped by the covering slag. Although there still remains a certain amount of these oxides in the metal when it solidifies, the morphology of the inclusions is controlled more adequately.

Another technique, used in a converter, purifies the metal with the help of a neutral gas, mainly nitrogen or argon. Its drawbacks are that it is only moderately effective and that it changes the carbon content of the bath, leading to a greater dispersion of carbon content in the casting.

These latter techniques may be grouped under the generic term of vacuum treatment techniques. Such techniques in general perform well, but they have the following additional drawbacks:

1. large investments;

2. high operational and maintenance costs due to the procedures used for obtaining a vacuum;

3. temperature losses requiring either overheating during casting, or a system to reheat the molten mass;

4. long processing time.

In the processes in which a gas containing oxygen is blown through a nozzle located under the surface of the bath, refining takes place in two stages:

1. Formation of a microslag mainly containing iron oxide according to the reaction:

$Fe+O\ FeO$

2. Decantation and reduction of said microslag: as it rises through the metallic mass this slag reacts with the carbon of the bath according to the reaction:

$FeO+C\ CO\ (gas)+Fe$

During refining, two stages may be distinguished:

1. An initial stage in which the bath contains sufficient carbon to reduce all the iron oxide produced: this occurs when the carbon content of the bath is above a certain value C*.

2. A second stage in which the carbon content in the metallic mass is too low to reduce all the iron oxide produced at the tip of the nozzle, leading to a notable reduction in the iron yield of the refining operation and an increase in the amount of iron oxide contained in the slag.

U.S. Pat. No. 3,930,843 describes a refining process through the bottom in which a mixture of oxygen and argon is introduced, through the bottom of the converter, into the molten steel bath, when the carbon content of said steel is lower than 0.25%. This introduction is carried out according to a process that includes three successive phases of dilution of the oxygen by the argon according to the carbon concentration in the metal bath. This patent gives no indication on how to obtain the desired steel concomitantly with a reduction in the duration of the refining process and the consumption of argon.

In French Pat. No. FR-A-2 448 572 a refining process for refining low carbon content steel in a converter is described, in which argon is introduced with the oxidizing gas as of a predetermined value of carbon content, in this case 0.02%. However, this value is too low to obtain low dissolved oxygen content steel. For such a value, the dissolved oxygen concentration is very important, and an injection of neutral gas cannot lower said content in an effective manner.

SUMMARY

One object of the present invention is to obtain, in a converter, steel which is at once low in carbon content (soft and extra-soft steel) and in oxygen content.

An additional object of the invention is to obtain steel "in the converter", i.e., directly in the converter and not after a certain number of phases, such as killing with aluminum, silicon, etc . . .

The present invention concerns a process which enables the above-mentioned drawbacks to be corrected, and the production of soft or extra-soft steel in the converter having a dissolved oxygen content of less than 200 ppm in the case of soft steel ($0.08<\%C<0.03$) and lower than 300 ppm in the case of extra-soft steel ($\%C<0.035$).

In accomplishing these ends, there is a provided a process for refining the pig from the bottom in which an oxidizing gas such as industrially pure oxygen is injected into the molten metal bath, and, during the last refining stage, i.e., as of a predetermined carbon content value of the bath, a mixture of oxidizing gas and of inert gas ensuring the dilution of the oxidizing gas is injected. The inert gas content of the injected mixture is made to vary, according to the carbon content of the bath, following a law corresponding to a dilution curve of the oxidizing gas that is located in an area determined by two envelope curves, to wit, a first maximum dilution curve defined by the straight line portions:

$x=-766.7\ \%C+168.7$ for $0.16<\%C<0.22$ $x=-550\%C+134$ for $0.1<\%C<0.16$ $x=-233\ \%C+102$ for $\%C<0.1$ and a second minimum dilution curve defined by the straight line portions:

$x=-1500\ \%C+255$ for $0.14\ \%C\ 0.17$ $x=-400\ \%C+101$ for $0.1\ \%C\ 0.14$ $x=-230\ \%C+84$ for $0.05\ \%C\ 0.1$ The dissolved oxygen content of the bath during the decarbonization process is kept substantially constant to thereby minimize the amount of iron oxide in the slag. Moreover, unexpectedly, this process is more economical for the objective sought, making it possible to diminish the quantity of argon used and to minimize the amount of iron oxide in the slag of the bath. According to a preferred embodiment of the invention, the total flow of the gaseous mixture (oxidizing gas and inert gas) injected through the bottom remains substantially constant during the entire refining period. This flow is preferably the maximum flow compatible with a "killing" refining of the bath, i.e., without important projections from the bath.

Moreover, contrary to the teachings of U.S. Pat. No. 3,930,843, the present invention uses argon as a dilution gas whose injection is controlled to diminish the CO concentration, thereby enabling, unexpectedly, a dissolved oxygen concentration in the metallic bath that is significantly constant during the entire duration of the process.

The inert gas injected during the last refining stage may be chosen from within a group that includes nitrogen, argon, helium, neon, krypton, xenon, or any mixture thereof.

By way of non-restrictive examples, various preferred embodiments of the invention are described below, with reference to the appended drawings.

DESCRIPTION OF CERTAIN PREFERRED EMBODIMENTS

Figure 1:
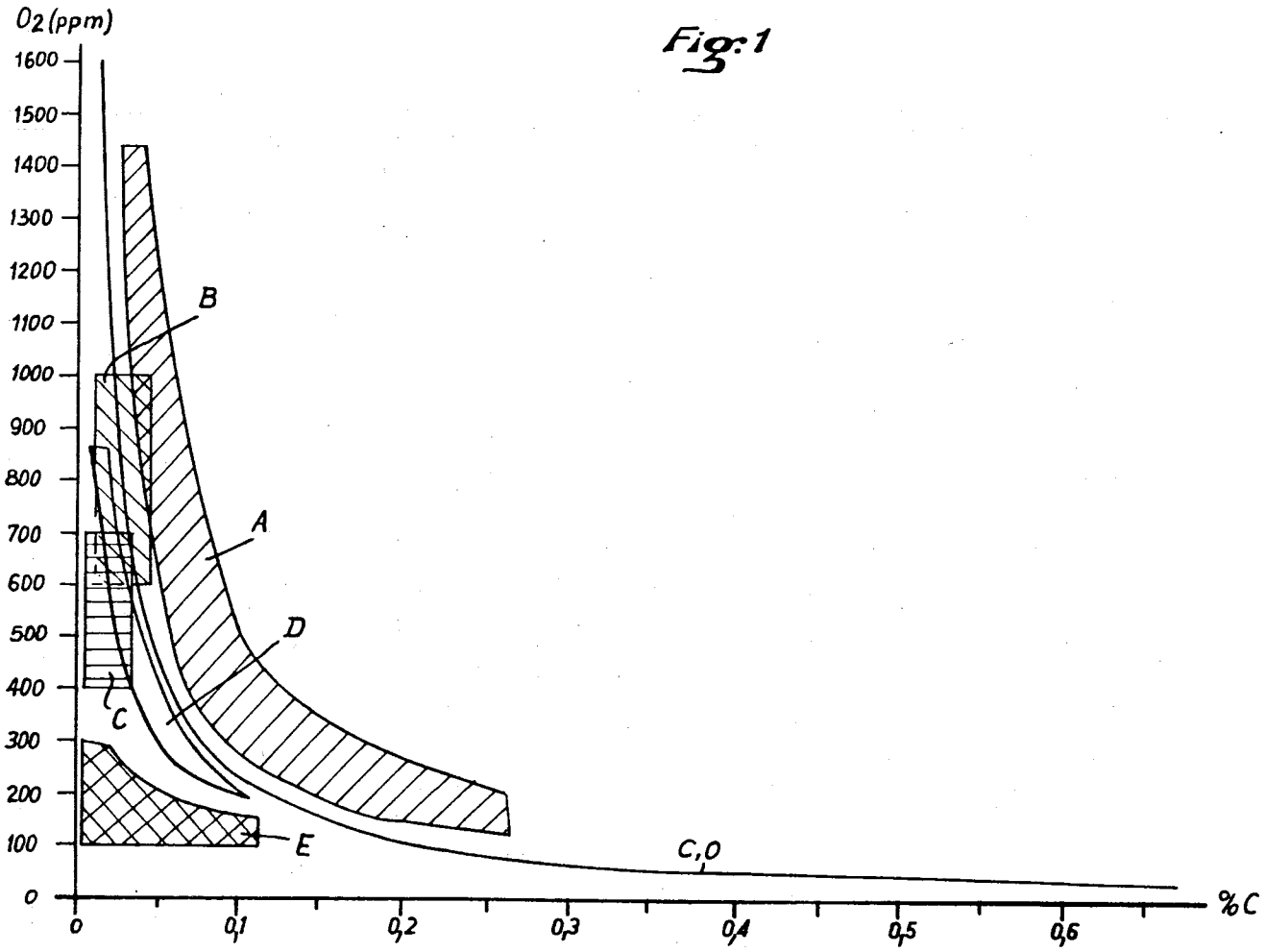
FIG. 1 is a diagram illustrating the variation in dissolved oxygen content according to the carbon content of a metallic bath in castings obtained according to different known processes and according to the invention.

Referring to FIG. 1 of the drawings, there is shown the manner in which the dissolved oxygen content, expressed in ppm along the ordinate, varies according to the carbon content of the metallic bath in the case of the different refining processes. Area A corresponds to known processes where refining is done from above, area B to known processes where refining is done from below, area C to known processes done from below with purification, area D to known processes of mixed refining methods, and area E is the area that may be reached with the help of the process according to the invention. The diagram also includes a C,O equilibrium curve at 1600° C. for a carbon monoxide pressure of one bar.

It can be seen, according to the diagram of FIG. 1, that the process according to the invention enables the realization of dissolved oxygen contents which are substantially lower than those of the previously known refining processes.

Various ways of putting the refining process according to the invention to use shall now be described, and the results obtained shall be compared to the traditional refining process from below.

Comparative Example 1

A model is produced in the laboratory of a converter blowing from below, equipped with an injection nozzle. 600 kg of liquid pig iron with 1.5% carbon at 1550° C. is loaded into this converter. Pure oxygen is then injected at a rate of 15 $Nm^3/h$ until the carbon content of the bath falls to 0.03% (this is the point 1*a* on the curve I in FIG. 3 corresponding to a dissolved oxygen content of 1280 ppm). At this time, jointly with the oxygen, industrially pure argon is injected into the bath at a constant rate of 15 $Nm^3/h$. Samples of the metal are taken at regular intervals in order to determine the variation of the dissolved oxygen content of the bath. After 3 minutes have elapsed, i.e., after consumption of 1.25 $Nm^3$ of argon/ton of steel produced, it can be seen that the carbon content of the bath has declined to 0.01% and that the dissolved oxygen content of the bath is now 750 ppm (point 1*b* on curve I of FIG. 3).

EXAMPLE 2

Figure 2:
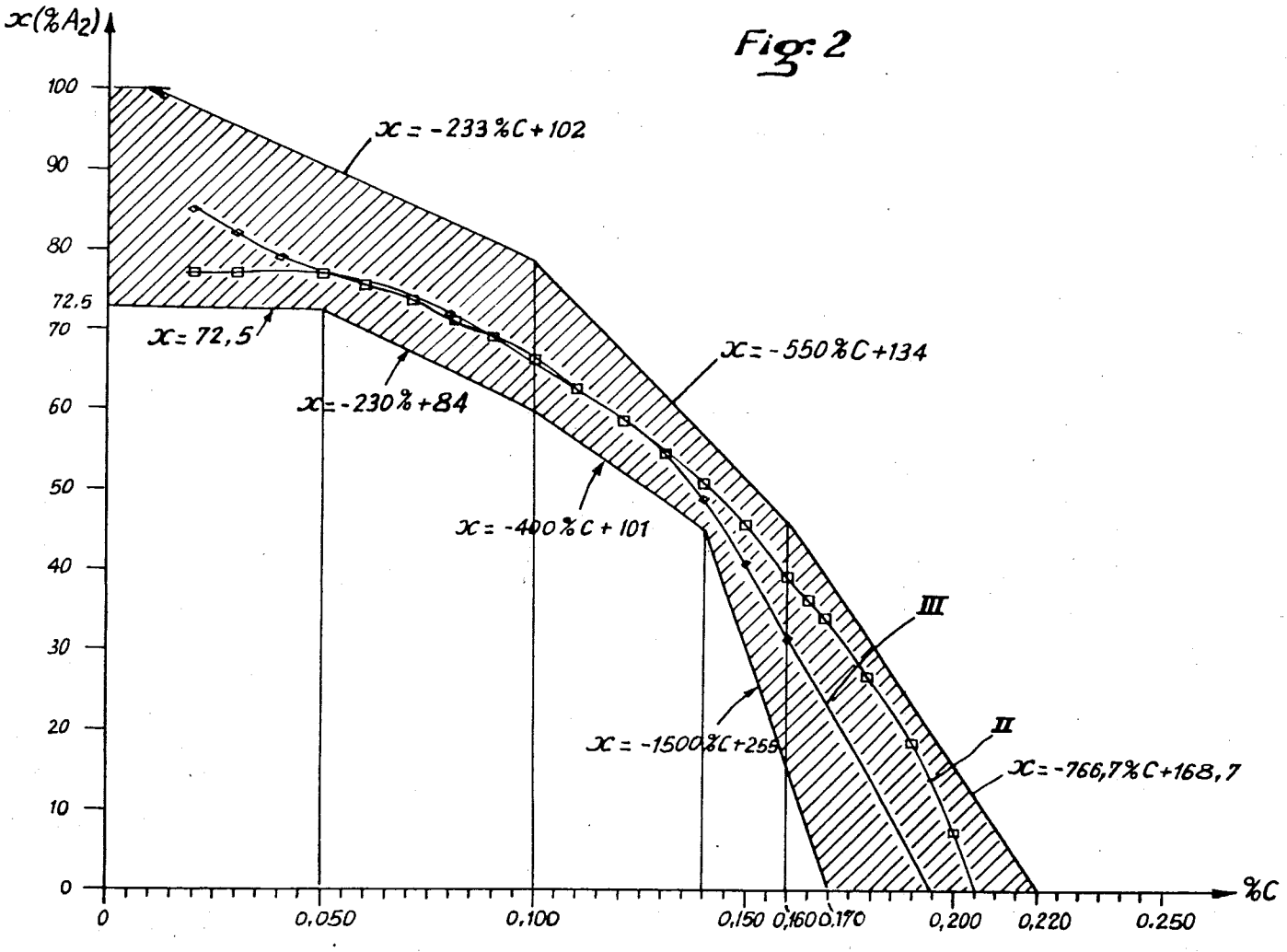
FIG. 2 is a diagram illustrating two laws of variation of the percentage of gas injected in the mixture according to the carbon content of the metallic bath, in the case of two examples of the process according to the invention, and the extension of the range of variation of the above-mentioned laws.

The same converter is loaded with 600 kg of liquid pig iron with 1.5% carbon. Industrially pure oxygen is injected at a rate of 15 $Nm^3/h$ until the bath shows a carbon content of 0.212%, the temperature now being 1647° C. At that time, the injected oxygen is diluted with argon according to the law corresponding to curve II in FIG. 2, the total flow of injected gas (inert gas +oxygen) now being constant. The dissolved oxygen content, according to the carbon content of the bath, varies according to curve II of the diagram of FIG. 3. When 12.5 minutes have elapsed, i.e., after a consumption of 3.2 $Nm^3$ of argon per ton of steel produced, the carbon content of the bath has declined to 0.01% while the dissolved oxygen content is 250 ppm (point 2*b* on curve II of FIG. 3). Said in a different way, a dissolved oxygen content of less than 500 ppm is obtained in comparison with the case of Example 1.

EXAMPLE 3

The same converter is loaded with 600 kg of liquid pig with 1.5% carbon. As before, oxygen is injected at a rate of 15 $Nm^3/h$ until a carbon content of 0.19% is obtained. The temperature of the bath is 1600° C. At this time, the oxygen injected is diluted by means of argon, the argon content of the injected mixture varying, according to the carbon content of the bath, along curve III of FIG. 2. The dissolved oxygen content now varies, according to the carbon content of the bath, along curve III of FIG. 3. After 9 minutes have elapsed, i.e., a consumption of 2.95 $Nm^3$ per ton of steel produced, the carbon content of the bath is 0.02% and its dissolved oxygen content is 180 ppm (point 3*b* of curve III of FIG. 3).

Figure 3:
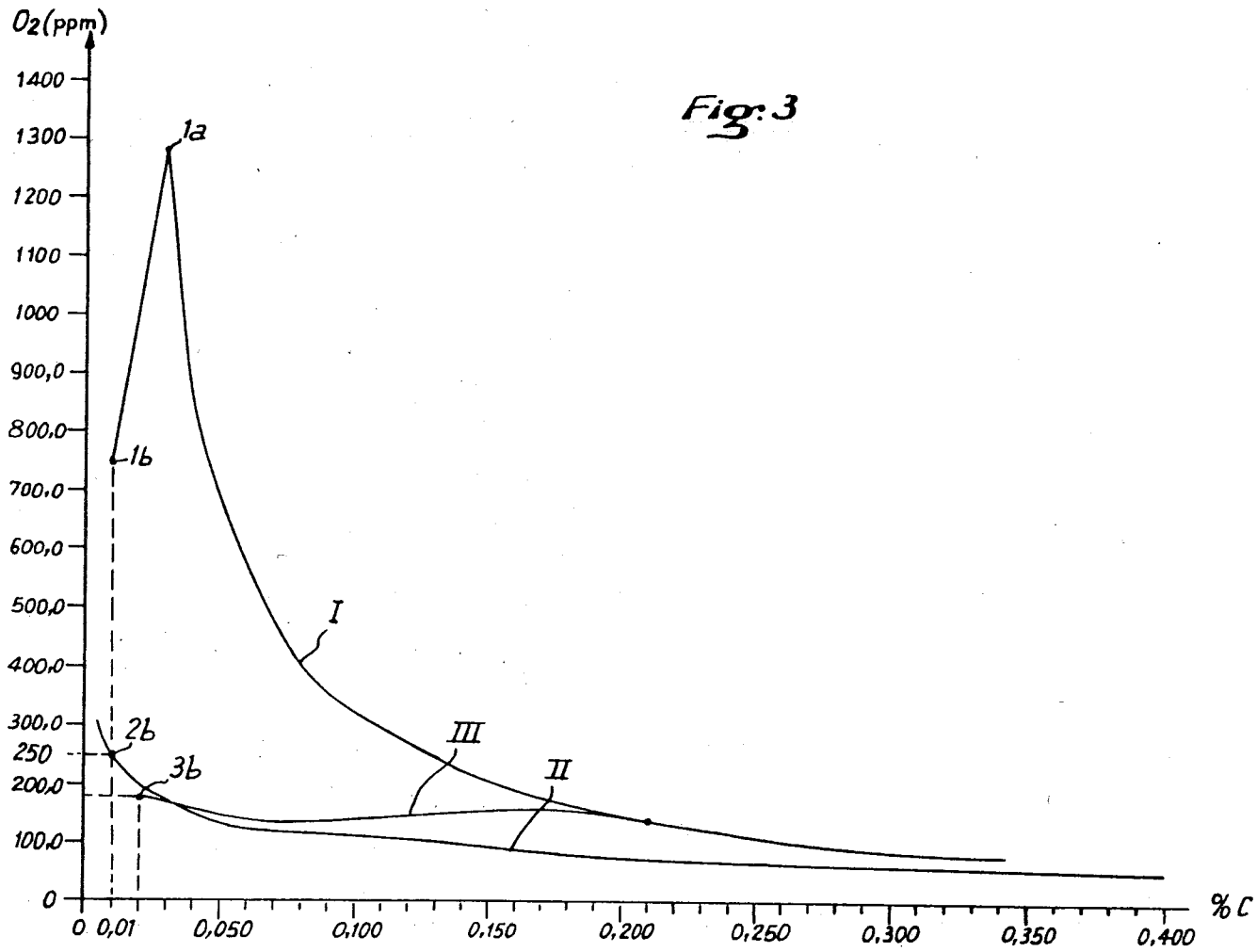
FIG. 3 is a diagram illustrating the variation in dissolved oxygen content according to the carbon content of the metallic bath in the case of a known process and a process according to the invention.

It can be observed that, according to curves II and III of FIG. 3, in examples 2 and 3 in which the process pursuant to the invention is used, the dissolved oxygen content of the bath does not go beyond 200 ppm up to a carbon content of 0.02%. This fact is a great advantage since it allows refining to be discontinued at the desired carbon content and a well deoxidized metallic bath to be obtained.

Moreover, it is well known that in conversion-processed steel a low dissolved oxygen content in the bath enhances the purification of dissolved gases such as nitrogen and hydrogen. By using inert gas with a very low capacity of dissolution in the steel, such as, e.g., argon, nitrogen and hydrogen contents may be obtained that are clearly lower than those obtained by prior conversion processes.

The terms and expressions that have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A multi-stage process for refining a molten metal bath of pig iron in successive refining stages, the process comprising, in combination:

injecting an oxidizing gas into the molten metal bath from beneath the surface of the bath;

thereafter injecting a mixture of oxidizing gas and inert gas into the bath from beneath its surface during the last refining stage; and varying the inert gas content of the mixture according to the carbon content of the bath, pursuant to a law corresponding to an oxidizing gas dilution curve that is located in an area determined by two envelope curves, to wit, a first maximum dilution curve defined by the straight line portions:

$x=-766.7\ \%C+168.7$ for $0.16<\%C<0.22$ $x=-550\%C+134$ for $0.1<\%C<0.16$ $x=-233\ \%C+102$ for $\%C<0.1$ and a second minimum dilution curve defined by the straight line portions:

$x=-1500\ \%C+255$ for $0.14<\%C<0.17$ $x=-400\ \%C+101$ for $0.1<\%C<0.14$ $x=-230\ \%C+84$ for $0.05<\%C<0.1$ $x=-72.5$ for $\%C<0.05$ in which x is the percentage of inert gas injected in the mixture and %C is the carbon content of the bath during the injection of said mixture.

2. A process for refining pig iron as defined in claim 1, in which the total flow of the gaseous mixture is maintained substantially constant during the entire last stage of refining.

3. A process for refining pig iron as defined in claim 1, in which the inert gas is selected from the group consisting of nitrogen, argon, helium, neon, krypton, xenon and mixtures thereof.

4. A product made according to the process of claim 1, in which the product has a dissolved oxygen content of less than 200 ppm for a carbon content lying between 0.03% and 0.08% and lower than 300 ppm for a carbon content of less than 0.035%.

5. A product according to claim 4, in which the dissolved oxygen content of the product is above 100 ppm.

6. A product according to claim 4 which is substantially chromium free.

7. A multi-stage process for refining a molten metal bath of pig iron in successive refining stages, the process comprising, in combination:

injecting an oxidizing gas into the molten metal bath from beneath the surface of the bath;

thereafter injecting a mixture of oxidizing gas and inert gas into the bath from beneath its surface during a final refining stage; and varing the inert gas content of the mixture according to the carbon content of the bath, pursuant to a law corresponding to an oxidizing gas dilution curve that is located in an area determined by two envelope curves, to wit, a first maximum dilution curve defined by the straight line portions:

$x=-776.7\%C+168.7$ for $0.16<\%C<0.22$ $x=-550\%C+134$ for $0.1<\%C<0.16$ $x=-233\%C+102$ for $\%C<0.1$ and a second minimum dilution curve defined by the straight line portions:

$x=-3100\%C+255$ for $0.14<\%C<0.17$ $x=-400\%C+101$ for $0.1<\%C<0.14$ $x=-230\%C+84$ for $0.05<\%C<0.1$ $x=-72.5$ for $\%C<0.05$ in which x is the percentage of inert gas injected in the mixture and %C is the carbon content of the bath during the injection of said mixture;

the molten metal bath following said final refining stage having a dissolved oxygen content of below 200 ppm for a carbon content lying between 0.03% and 0.08% and below 300 ppm for a carbon content of less than 0.035%.

8. A multi-stage process for refining a molten metal bath of pig iron in successive refining stages, the process comprising, in combination:

injecting an oxidizing gas into the molten metal bath from beneath the surface of the bath during a first refining stage;

maintaining the gas injected into the molten metal bath substantially free of inert gas during the first refining stage;

thereafter injecting a mixture of oxidizing gas and inert gas into the bath from beneath its surface during a final refining stage; and varying the inert gas content of the mixture according to the carbon content of the bath, pursuant to a law corresponding to an oxidizing gas dilution curve that is located in an area determined by two envelope curves, to wit, a first maximum dilution curve defined by the straight line portions;

$x = -776.7\%C + 168.7$ for $0.16 < \%C < 0.22$ $x = -550\%C + 134$ for $0.1 < \%C < 0.16$ $x = -233\%C + 102$ for $\%C < 0.1$ and a second minimum dilution curve defined by the straight line portions:

$x = -1500\%C + 255$ for $0.14 < \%C < 0.17$ $x = -400\%C + 101$ for $0.1 < \%C < 0.14$ $x = -230\%C + 84$ for $0.05 < \%C < 0.1$ $x = -72.5$ for $\%C < 0.05$ in which x is the percentage of inert gas injected in the mixture and %C is the carbon content of the bath during the injection of said mixture.

* * * * *